United States Patent [19]

Yamada et al.

[11] 4,203,782

[45] May 20, 1980

[54] STEEL HAVING A UNI-DIRECTIONAL LAMELLAR MARTENSITE STRUCTURE IN AN AUSTENITE MATRIX

[75] Inventors: Senichi Yamada; Yoshio Kato, both of Nagoya, Japan

[73] Assignee: Kabushiki Kaisha Toyota Chuo Kenkyusho, Japan

[21] Appl. No.: 920,065

[22] Filed: Jun. 28, 1978

[30] Foreign Application Priority Data

Jun. 28, 1977 [JP] Japan ..... 52-76727

[51] Int. Cl.[2] ..... C21D 1/22; C21D 9/02

[52] U.S. Cl. ..... 148/12 E; 148/12.4; 148/37; 148/38

[58] Field of Search ..... 148/12 E, 12.4, 37, 148/38

[56] References Cited

U.S. PATENT DOCUMENTS

| | | | |
|---|---|---|---|
| 2,795,519 | 6/1957 | Angel et al. | 148/12.4 |
| 3,093,519 | 6/1963 | Decker et al. | 75/123 J |
| 3,340,102 | 9/1967 | Kulin et al. | 148/12.4 |
| 3,446,333 | 5/1969 | Bhatt et al. | 148/12.4 |
| 4,042,421 | 8/1977 | van den Sype et al. | 148/12.4 |
| 4,042,423 | 8/1977 | van den Sype et al. | 148/12.4 |

*Primary Examiner*—W. Stallard

*Attorney, Agent, or Firm*—Berman, Aisenberg & Platt

[57] ABSTRACT

Heat-treated steel of particular, but known, composition is quenched, worked in one direction and then hardened by tempering to form a uni-directional lamellar structure of tough martensite in a uniform austenite matrix.

37 Claims, 6 Drawing Figures

(X100)

STEEL HAVING A UNI-DIRECTIONAL LAMELLAR MARTENSITE STRUCTURE IN AN AUSTENITE MATRIX

BACKGROUND

When steel is heat treated to increase its strength, it is concurrently made subject to embrittlement in a hydrogen atmosphere. Use of steel in, e.g., a chemical or nuclear process or under circumstances wherein it is in contact with sea water often requires high-tensile strengths, but attempts to produce such steel result in products which suffer from a marked brittleness phenomenon caused by hydrogen and resulting from the strengthening treatment.

Many basic steel compositions are known, including those referred to in U.S. Pat. No. 3,093,519, the entire relevant disclosure of which is incorporated herein by reference. Such compositions provide suitable starting materials for the present invention.

SUMMARY

Steel having high tensile strength and excellent resistance to hydrogen-brittleness cracking is produced by subjecting a starting steel, such as one of a suitable composition referred to in U.S. Pat. No. 3,093,519, to a solution heat treatment (comprising heating and quenching) to provide a uniform austenite structure, working the resulting heat-treated steel in one direction to provide a uni-directional lamellar martensite structure (having toughness) in the austenite matrix and then tempering the thus-worked steel to increase the strength of the martensite structure. Resulting steel (produced according to the present invention) has a lamellar structure of the worked and tempered martensite in a uniform austenite matrix. The worked and tempered martensite structure provides high tensile strength, and the uniform austenite structure has sufficiently high elongation to provide excellent hydrogen-brittleness-cracking resistance. Steel according to the present invention has e.g., high tensile strength in the order of 150 kg/mm$^2$ or higher, as well as excellent hydrogen-brittleness-cracking resistance. Of course, steel of lower tensile strength may also be produced analogously.

Generally speaking, when steel of a uniform austenite structure (obtained by solution heat treatment) is cooled to a temperature not higher than an Ms temperature and not lower than an Mf temperature of the steel, a mixed structure, consisting of martensite and austenite, results. However, there is no assurance that thus-obtained steel has desired or any substantial level of hydrogen-brittleness-cracking resistance. As martensite therein is present in a mixed form, with directional freedom and, when placed in a hydrogen atmosphere, cracks (in respective discrete hard martensite portions) contacting with one another are continuously joined together (because the hard martensite and non-brittle austenite are not formed in uni-directional lamellar structure in such steel), thus leading to rupture of the steel.

However, the mere provision of a lamellar structure of martensite in an austenite matrix does not assure improved hydrogen-brittleness-cracking resistance. When cracking (due to the presence of hydrogen) takes place in martensite, the cracking produced in martensite propagates into an austenite layer, whereupon stress-induced martensite (not having toughness due to cracking) is produced in the austenite layer in a direction of an extension of cracking or in the direction perpendicular to the direction of the stress which acts thereon, with the result that the cracking grows along the stress-induced martensite.

Stated simply, the problem was to produce a high-tensile-strength steel free from or resistant to hydrogen-brittleness cracking. Whereas solution heat treatment, including both heating and quenching, produces sufficiently high tensile strengths in steel of known compositions, the same heat treatment concurrently reduces the resistance of the heat-treated steel to hydrogen-brittleness cracking. This invention provides a method of imparting resistance to hydrogen-brittleness cracking to thus heat-treated steel, particularly that having subsequently-defined compositions. It also provides the resulting steel with the correspondingly-indicated properties.

DEFINITIONS

Figure 1:
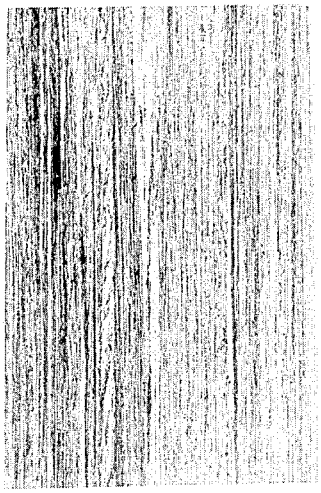
FIG. 1 is a photomicrograph representing the structure of steel provided according to the process of the invention.
Figure 5:
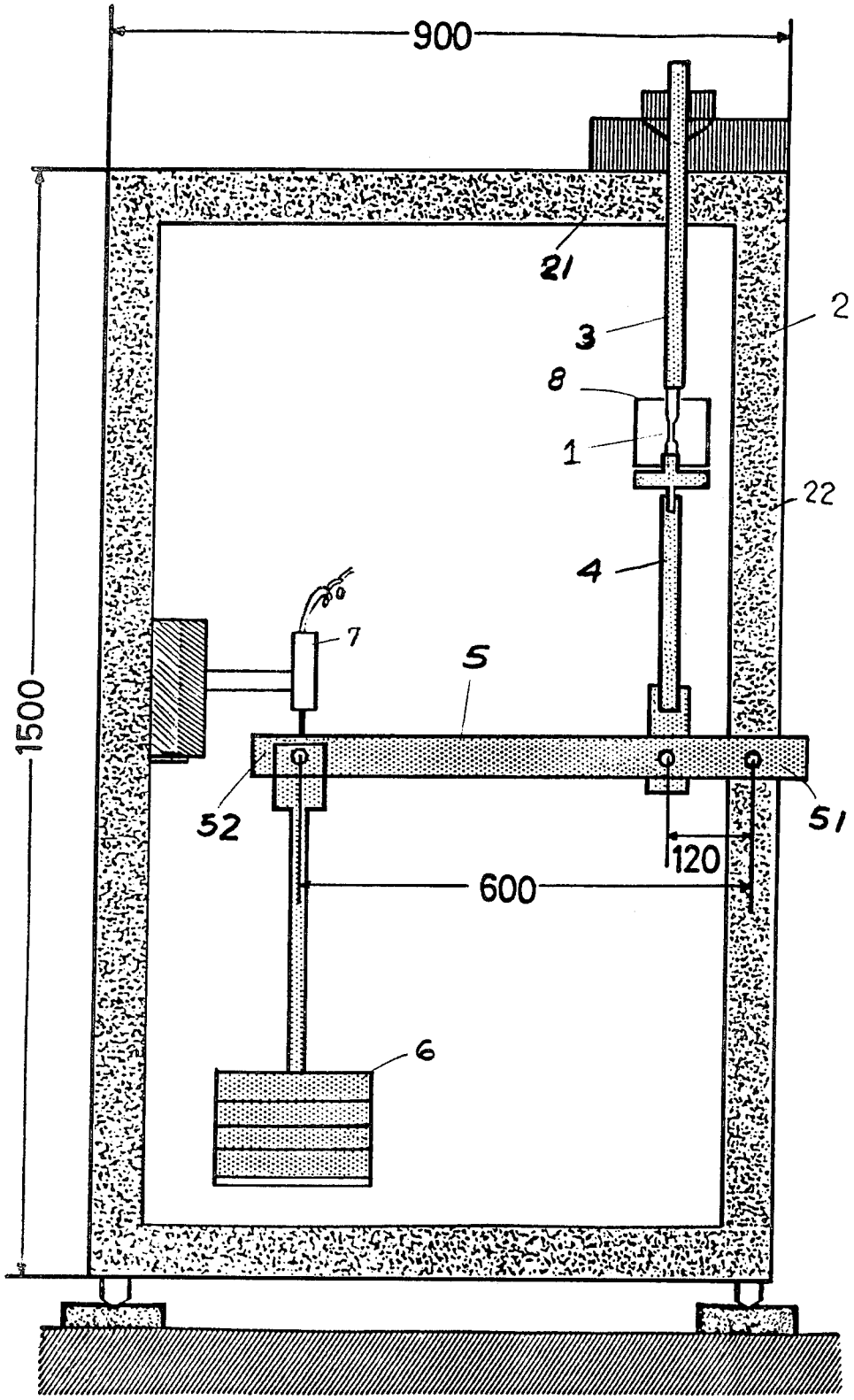
FIG. 5 is a whole view of a testing device for evaluating the lower limit stress of a steel.
Figure 6:
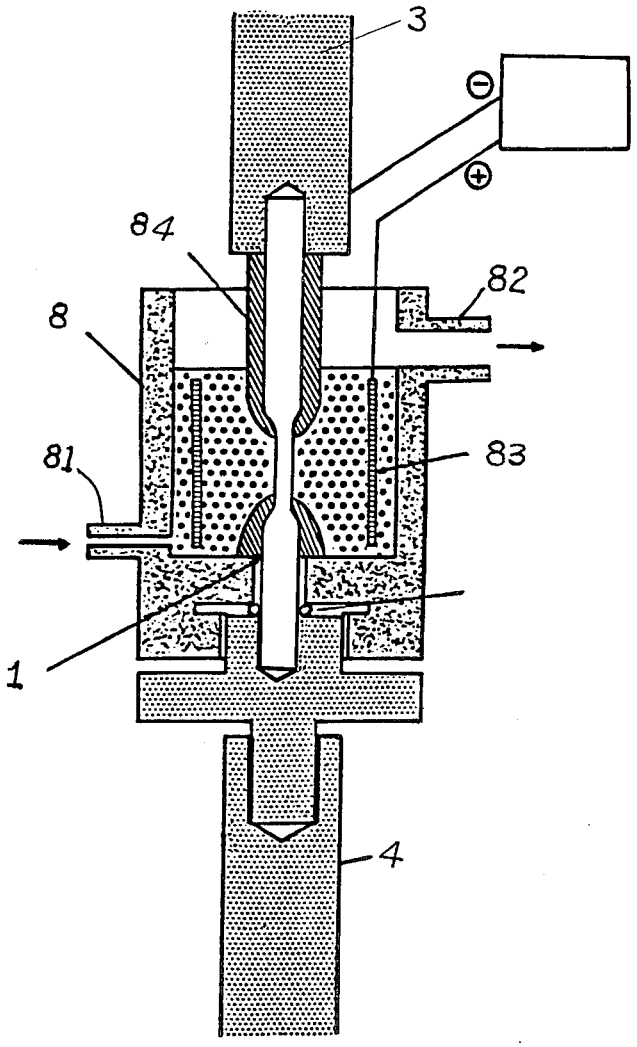
FIG. 6 is an enlarged partial view of the testing device shown in FIG. 5.

Throughout the text (disclosure and claims) words, expressions and symbols are used according to standard and recognized meanings. Certain words, expressions and symbols are hereinafter defined. These words are used throughout the text according to these definitions in the absence of an express contrary indication.

atomic present—The number of atoms of an element in 100 atoms representative of a substance.

austenite matrix—Gamma iron solid solution in which martensite is embedded.

salt bath—Molten salt composed of halide such as $BaCl_2$, in which starting steel is heated for solution heat treatment at a temperature ranging from 1000° C. to 1200° C.

solution heat treatment—A treatment in which an alloy is heated to a suitable temperature and held at this temperature for a sufficient length of time to allow a desired constituent to enter into solid solution, followed by rapid cooling to hold the constituent in solution. The material is then in a supersaturated, unstable state and may subsequently exhibit age hardening.

elongation (sufficient) in the austenite—means that austenite has greater elongation than martensite does. (Here, elongation means ductility which permits deformation to occur without fracture.)

vacuum casting—A technique for producing steel ingots which degases the steel. The procedure is as follows: on entering the vacuum, the steel is more or less broken up, according to the size of the vacuum, the diameter of the stream of steel flowing from the ladel, and the rate of casting.

vacuum melting—Metal is melted in a vacuum. (Here, metals are melted under $10^{-1}$ to $10^{-2}$ torr.)

hydrogen cracking—hydrogen embrittlement (=hydrogen brittleness cracking) Loss of ductility caused by the absorption of hydrogen in steel and sometimes encountered in acid pickling of sheet steel.

excellent hydrogen-brittleness-cracking resistance—Here, it means a lower limit strength over 100 kg/mm$^2$ according to the test described herein.

lower limit stress (lower limit strength)—The physical meaning of the lower limit stress (corresponding to lower critical stress) is described in Trans. ASM Vol. 52 P54–80 (1960). In the specification, lower limit stress is defined as the highest strength of a sample which withstands a load for 10 hours under a cathode electrolysis condition in view of the relation between the aforenoted load or stress level and during the time required until the breaking of a sample. The testing device used here is shown in FIGS. 5 and 6.

testing device for evaluating a lower limit stress of a steel—The testing device is shown in FIGS. 5 and 6. The device comprises a frame 2 (900 mm×1500 mm×520 mm), an upper pull rod 3 fixed on the ceiling 21 of the frame 2, a lower pull rod 4, a lever 5 one end 51 of which is pivotted on the side wall 22 of the frame 2 and the lower pull rod 4 being connected to one portion of the lever 5, i.e. near the end 51 of the lever 5, a differential transfer 7 connected to the other end 52 of the lever 5 for detecting the elongation of a testing sample 1 and an atomospheric chamber 8 placed between the upper pull rod 3 and the lower pull rod 4. A sample 1 to be tested has a shape shown in FIG. 6. The length of the sample is 80 mm, the diameters of the both end portions are 6 mm and the length and the diameter of the parallel portion are 15 mm and 3 mm, respectively. The sample 1 is put in the chamber 8 and fixed on the both end portions to the upper pull rod 3 and the lower pull rod 4. Then an insulating varnish 84 is coated on the whole surface of the sample 1 except the surface of the most of the parallel portion (10 mm×3 mm $\phi$). The chamber 8, which is made of polymethylmethacrylate, has an inlet 81 and an outlet 82. Two lead plates 83 which are used as anodes are placed in the chamber 8. An electrolyte, a 2.5% sulfuric acid ($H_2SO_4$) solution containing 100 milligrams per liter of diarsenic trioxide ($AS_2O_3$) is continuously introduced into the chamber 8 through the inlet 81 at a rate ranging from 10 to 15 milliliters per minute and taken out continuously through the outlet 82. Then a direct current is applied between the sample 1 which is used as a cathode and the lead plates 83 used as anodes. So the sample 1 is exposed to hydrogen generated by the electrolysis. The cathodic current density is regulated to be 0.1 A/cm$^2$. The current is applied continuously till the sample is broken. After two hours from the application of the current, the sample 1 is loaded to a stress at a given level by the weight 6. During the loading, the strain of the sample 1 is measured by the differential transfer 7 and the duration time of the sample 1 is measured. In this manner, many samples are tested and the largest strength of the same samples, which can stand to the load for at least 10 hours, is obtained. Here, the largest strength is defined to be a lower limit stress.

lamellar martensite layers—One of the two constituents which form lamellar structure. (Here, they are of martensite and austenite.)

lamellar structure—One consisting of fine alternating parallel layers of two constituents, e.g., the structure shown in FIG. 1.

martensite (at least 10 percent by volume)—

$$\frac{\text{the volume of martensite}}{\text{the volume of martensite + the volume of austenite}} \times 100$$

deformation induced martensite and stress induced martensite—In the art, deformation induced martensite and stress induced martensite can not be clearly distinguished from each other. (Here, deformation induced martensite means the martensite which is formed by working. Stress induced martensite means the martensite which is formed by concentrated stress.)

quenching—Rapid cooling from an elevated temperature, generally carried out by immersion in a liquid bath of oil or water. Quenching oils consist of two main classes, fatty oils and mineral base oils. The latter type includes the straight mineral oils, compound and additive oils. Other quenching fluids include brine, and dilute caustic soda solution, the latter two media being used to give a more drastic quench than water. Salt baths or fused metals are used for special heat treatments such as austempering. The usual effect of quenching is to confer hardness as the sudden abstraction of heat suppresses the phase transformation of austenite to pearlite, forming instead the harder constituents bainite or martensite. The austenitic steels, such as the corrosion-resistant steels of the 18% chromium, 8% nickel type, and the 14% manganese steels, are not hardened by quenching.

reduction of area—The percentage decrease in cross-sectional area of bar or wire after rolling or drawing.

maraging steel—High-strength, low-carbon iron-nickel alloy in which a martensitic structure is formed on cooling; contains 7–6% nickel, 0–11% cobalt, 0–5% molybdenum, and small percentages of titanium, aluminum, and columbium; hardening is accomplished by heating the quenched alloy at 400°–500° C.

high tensile strength—Tensile strength means the maximum stress a material subjected to a stretching load can withstand without tearing. (Here, high tensile strength means a strength over 150 kg/mm$^2$.)

toughness—Stress induced martensite and un-tempered deformation induced martensite are tough, which means that these martensites are much ductile then tempered (or hardened) martensite.

working in one direction—includes rotary swaging, drawing, extrusion, rolling, etc.

rotary swaging—A mechanical means of reducing the diameter of bars or tubes, or of pointing and shaping the ends of rods and tubes, by hammering the metal, using rotary dies. The required shape is cut into the striking face of the dies, which rotate during the process and, therefore, the form of the finished component must be cylindrical. Swaging imparts to components the same benefits as those obtained in forging. Tensile strength and elastic properties of metals are said to be improved.

Ms temperature—The temperature at which transformation of austenite to martensite starts during cooling.

Mf temperature—The temperature at which martensite formation finishes during cooling. All the critical points occur at lower temperatures during cooling than during heating, and depend on the rate of change of temperature.

DETAILS

The present invention starts with steel which is hardenable by tempering and wherein working results in the production of tough martensite. In such steel a unidirectional lamellar structure of tempered martensite is formed in a uniform austenite matrix.

An extremely important feature of the invention is that a uni-directional lamellar structure of deformation-induced martensite is produced in an austenite matrix by working the steel; thus obtained martensite is tempered; and, respective tempered martensite layers are thus interposed among austenite-matrix layers having sufficient elongation.

The starting steel is optionally one of known composition or one which is readily prepared from known components by analogy procedures. This steel has a composition which permits forming tough lamellar martensite therein by working and strengthening by tempering. The selected steel is, in fact, tempered to increase its strength substantially. Even when stress-induced martensite is produced (due to hydrogen-cracking in the martensite layer) in the austenite matrix, the propagation of cracking is reduced, curtailed or eliminated because the stress-induced martensite (produced in the austenite matrix) is tough and the austenite matrix has sufficient elongation.

The starting steel is one wherein deformation induced by working produces tough martensite, the strength of which is increased by tempering. Of particular interest in this regard are steel compositions which comprise titanium, aluminum and beryllium. Steel of such compositions makes possible the production (according to this invention) of high-tensile-strength steel free from hydrogen-brittleness cracking.

More particularly, one aspect of the present invention involves starting with steel containing (in percent by weight) from 15 to 27 percent of nickel, from 5 to 10 percent of cobalt, from 1 to 7 percent of molybdenum, from 0.2 to 2.0 percent of titanium, from 0.2 to 2.5 percent of aluminum and from 0.05 to 0.80 percent of beryllium, the balance being substantially iron. According to the process of the invention, such starting steel is heated to a temperature not lower than 850° C. and not higher than the melting point of the starting steel; thus-heated starting steel is then quenched to a temperature within the range from an Ms temperature to a temperature which is 150° C. higher than the Ms temperature to provide a uniform austenite structure; thereafter, the steel is worked in one direction at the last-noted temperature to produce deformation-induced martensite having a lamellar structure in a uniform austenite matrix. This is followed by tempering to increase the strength of the martensite. This process produces steel of extremely high tensile strength and excellent hydrogen-brittleness-cracking resistance.

It is essential for martensite (due to the working), such as deformation-induced martensite and stress-induced martensite, in the steel to be tough, and it must be possible to increase the strength thereof by tempering. An alloy composition of maraging steel meets these requirements, and hence suitable starting steel compositions according to the present invention include those which are in the category of maraging steel. However, preferred starting steel according to the present invention achieves high tensile strength with relative ease, because its composition comprises from 15 to 27 weight percent of nickel, from 5 to 10 weight percent of cobalt and from 1 to 7 weight percent of molybdenum, in addition to a small amount of each of titanium, aluminum and beryllium, the content of which was previously indicated.

When the starting steel comprises less than 0.2 percent by weight of titanium, less than 0.2 percent by weight of aluminum and/or less than 0.05 percent by weight of beryllium, freedom from hydrogen-brittleness cracking is not assured even when the process of this invention is otherwise adhered to. When the starting steel comprises too much titanium, e.g. more than 2.0 percent by weight, aluminum, e.g. more than 2.5 percent by weight, and/or beryllium, e.g. more than 0.80 percent by weight, the forgeability of the produced steel tends to be lowered and working is thus accomplished only with greater difficulty. Without working, finished steel suitable for practical use is not obtained according to this invention.

Starting steel of a suitable composition is first subjected to solution heat treatment to provide a uniform austenite structure. It is then worked in one direction to produce a uni-directional lamellar structure of martensite in an austenite matrix. Working is effected af a temperature ranging from an Ms temperature to a temperature which is 150° C. higher than the Ms temperature. When working is effected at a temperature which is in excess of the temperature which is 150° C. higher than the Ms temperature, it is difficult to form a uni-directional lamellar martensite structure. On the other hand, when the working temperature is lower than the Ms temperature, the martensite transformation takes place without working, and thus-produced martensite is not directionally oriented in its structure; instead, it has a structure similar to that of maraging steel and thus fails to attain the objects of the present invention. Working according to the present invention should be limited to one direction, and to this end martensite of uni-directional lamellar structure is preferably produced in the austenite matrix in an amount of at least 10 percent by volume. Unidirectional working provides deformation-induced martensite of a lamellar structure extending in one direction in an austenite matrix. Austenite layers having sufficient elongation to resist cracking are interposed among lamellar martensite layers.

The uni-directional lamellar martensite is preferably present in the structure in a proportion of at least 10 percent and up to 95 percent, or more, by volume. When the amount of martensite is less than 10 percent by volume, the upper tensile-strength limit is severely restricted.

The reduction of area required for producing at least 10 percent by volume of uni-directional lamellar martensite varies with the steel composition, with the working temperature, and the like; it is thus not appropriate to limit the reduction in area to any particular proportion of the initial area. For instance, within a working temperature range over an Ms temperature, lamellar martensite may be produced with relative ease at lower temperatures. However, it becomes more and more difficult to produce such martensite (even within this temperature range) as the working temperature is increased. An exemplary range of area reduction during uni-directional working is from about 45 to 99 percent.

After starting steel is thus prepared so as to provide a lamellar structure of martensite in a uniform austenite matrix, the steel is tempered. Tempering is preferably effected within a temperature range of from 300° to 600° C. The strength of starting steel (according to the present invention) is increased by such a tempering treatment.

In this manner, steel obtained according to the present invention has, e.g., a tensile strength as high as 150 kg/mm$^2$ or even more. Although steel with such a high tensile strength ordinarily tends to be subject to substantial hydrogen-brittleness cracking, steel prepared according to the present invention possesses a high resistance to hydrogen-brittleness cracking in combination with high tensile strength. This is made possible by the uni-directional lamellar structure of tempered martensite which is interposed among austenite layers having sufficient elongation. Further, even when stress-induced martensite is produced in austenite layers by cracking developed in previously-noted tempered martensite layers, the development of cracking can be prevented because the stress-induced martensite produced in austenite layers due to cracking is not tempered and is not brittle. Accordingly, the present invention solves a problem of conflicting relationships between improving strength of steel and improving hydrogen-brittleness-cracking resistance of the same steel; it provides excellent steel having these conflicting properties.

The tensile strength of produced steel cannot be evaluated in the abstract because high tensile strength, i.e. at least about 150 kg/mm$^2$, in combination with absence from or excellent resistance to hydrogen-brittleness cracking is required. As the lower-limit strength is a measure of resistance to hydrogen-brittleness cracking and lower-limit strength tends to decrease with increased tensile strength, preferred tensile strength ranges are from about 150 to about 220 kg/mm$^2$ for lower-limit strengths in excess of about 140 kg/mm$^2$, from about 220 to about 260 kg/mm$^2$ for lower-limit strengths in excess of about 130 kg/mm$^2$, and in excess of about 260 kg/mm$^2$ for lower-limit strengths in excess of about 100 kg/mm$^2$. Products prepared according to this invention suitably have a tensile strength in excess of 150 kg/mm$^2$ and a lower-limit strength of at least 100 kg/mm$^2$ or advantageously in excess of 110 kg/mm$^2$.

EXAMPLES

In the following examples all parts and percentages are by weight unless otherwise specified. These examples are merely illustrative. Although they include preferred embodiments, they are in no way limitative of either the disclosure or the claims.

Composition and Form—Samples of various compositions in the form of round steel bars having a diameter of 20 mm are prepared by sequentially vacuum melting, vacuum casting, tempering at a temperature of 1100° C. for 16 hours and forging at a temperature of from 1000° to 1100° C.

Typical compositions of the steel samples are:

Table of Typical Chemical Compositions

| Type of steel sample | Chemical composition weight percent (atomic percent) | | | | | | |
|---|---|---|---|---|---|---|---|
| | Ni | Co | Mo | Ti | Al | Be | Fe |
| *Ms 20° C. | 25 | 9 | 5 | 0.4 | 0.3 | 0.60 | the balance |
| A | | | | | | | |
| Mf −70° C. | (23.86) | (8.57) | (2.91) | (0.47) | (0.62) | (3.73) | |
| Ms 0° C. | 25 | 9 | 5 | 0.4 | 2.0 | 0.08 | the balance |
| B | | | | | | | |
| −70° > Mf > −196° C. | (24.08) | (8.65) | (2.94) | (0.47) | (4.19) | (0.50) | the balance |
| Ms −30° C. | 25 | 9 | 5 | 1.4 | 0.8 | 0.26 | |
| C | | | | | | | |
| −70° > Mf > −196° C. | (24.11) | (8.66) | (2.94) | (1.65) | (1.68) | (1.64) | the balance |
| Ms 180° C. | 20 | 9 | 5 | 0.4 | 0.3 | 0.60 | |
| D | | | | | | | |
| Mf 120° C. | (19.05) | (8.55) | (2.90) | (0.47) | (0.62) | (3.72) | the balance |
| Ms 220° C. | 18 | 9 | 5 | 0.4 | 0.3 | 0.60 | |
| E | | | | | | | |
| Mf 140° C. | (17.13) | (8.54) | (2.90) | (0.47) | (0.62) | (3.72) | the balance |
| Ms < −196° C. | 25 | 9 | 5 | 3.4 | 0.3 | 0.08 | |
| F | | | | | | | |
| Mf < −196° C. | (24.38) | (8.76) | (2.98) | (4.06) | (0.64) | (0.51) | the balance |

*the values of Ms and Mf are approximate temperature

For compositions according to the invention the total amount of titanium, aluminum and beryllium is preferably 1.5 to 6.0 atomic percent, based on the total steel composition as 100 atomic percent.

Preparation and Solution Heat Treatment—Thus-prepared round bars are subjected to machining or turning to remove oxides from their surfaces, thereby providing round bars of a diameter of 18 mm. Then, the bars are heated in a salt bath at a temperature of 1180° C. prior to being quenched in a liquid maintained at a temperature slightly higher than the Ms temperature of each steel sample. The steel sample A is quenched in warm water at a temperature of 50° C.; the steel sample B is quenched in water at a temperature of 20° C.; the steel sample C is quenched in ice water of 0° C.; the steel sample D is quenched in oil at a temperature of 200° C.; the steel sample E is quenched in oil at a temperature of 240° C.; and the steel sample F is quenched in (dry ice)/(ethyl alcohol) at −70° C. The steel samples are heated and quenched in this manner for the solution heat treatment, thereby obtaining a structure of a single phase of austenite.

Working—The steel samples subjected to the aforenoted solution heat treatment are maintained at temperatures of respective cooling media, followed by forging with rotary swages. Such forging is effected (in known manner) to produce a uni-directional lamellar structure of martensite in a matrix of austenite possessed by each steel sample. To prove this production, typically, a photomicrograph, in which magnification of 100 is used, of the structure of the steel sample A is shown in FIG. 1. The structure shown in FIG. 1 is such that the reduction of area is 95 percent, and the amount of uni-directional lamellar martensite is 78 percent by volume.

Figure 3:
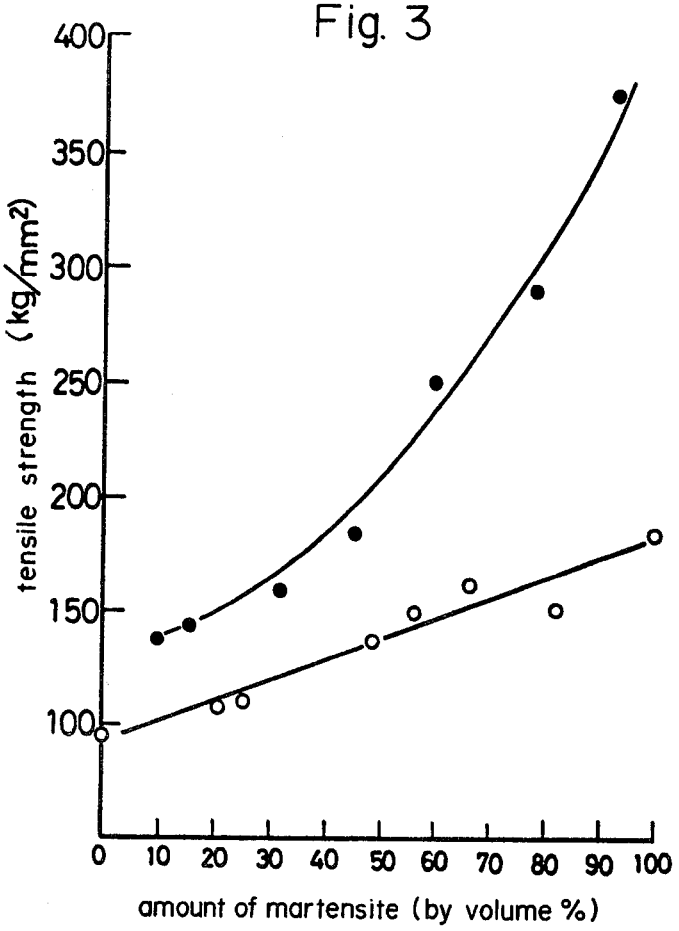
FIG. 3 is a graph representing the relationship between the amount of martensite in the structure and the tensile strength of steel samples prepared according to the present invention, plus steel samples used for comparison.

Tempering—The respective worked samples are subjected to tempering at suitable temperatures, thereby obtaining extremely high strength for steel samples. As one example thereof, the tensile strength of steel sample A is shown in FIG. 3. The marks • appearing in FIG. 3 represent the relationship between the amount of uni-directional lamellar martensite produced in the austenite matrix thus obtained and the tensile strength of the steel of sample A when tempered at a temperature of 450° C. for one hour. The amount of uni-directional lamellar martensite primarily depends on the reduction of area and working temperature. As far as the same type of steel sample is concerned, the higher the reduction of area or the lower the working temperature, the greater the amount of produced uni-directional lamellar martensite. FIG. 3 refers to the steel sample A obtained when the working temperature, i.e. about 50° C., was maintained constant. In this case, the amount of uni-directional lamellar martensite merely depends on reduction of area. For instance, the amounts of uni-directional lamellar martensite of 10%, 20%, 40%, 60%, 80% and 95% correspond to the reduction of area of about 45%, 65%, 80%, 90%, 95%, and 99%, respectively.

As can be seen from FIG. 3, the tensile strength of the steel according to the present invention reaches 140 kg/mm$^2$ when the amount of uni-directional lamellar martensite in the structure is 10 percent by volume, and the tensile strength thereof is increased as the amount of uni-directional lamellar martensite is increased, thereby eventually affording a tensile strength in excess of 350 kg/mm$^2$.

The marks o in FIG. 3 represent the tensile strength of conventionally-treated steel sample A. Such treatment comprises: (a) heating the steel sample A at 1180° C., (b) quenching the steel sample A in various cooling media, respectively, each maintained at a distinct temperature within the range of from +50° to −196° C., for obtaining quenched martensite of varying amounts ranging from 0 percent to 100 percent by volume, and c) tempering thus-quenched samples at 450° C., respectively. The tensile strength is substantially proportional to the amount of quenched martensite. The highest tensile strength thus obtained is about 180 kg/mm$^2$ for 100 percent by volume of martensite. It is noteworthy that the tensile strength for 100 percent by volume of martensite corresponds to that for ordinary heat-treated steel (referred to as maraging steel).

FIG. 3 illustrates that the tensile strength of steel samples prepared by tempering uni-directional lamellar martensite (obtained by working) is much higher than that of steel samples which were conventionally quenched and tempered without intermediate working specifically designed to produce the uni-directional lamellar martensite.

Testing—Various hydrogen-brittleness-cracking tests were conducted on steel samples to compare steel products according to the present invention with various competitive prior-art steel samples. The test procedure involves loading samples by means of a lever. More particularly, samples are exposed to hydrogen for two hours under no-load conditions in a fresh hydrogen atmosphere. In this respect, a sample and a lead plate are immersed in a 2.5 percent sulfuric acid ($H_2SO_4$) solution containing 100 mg/l of diarsenic trioxide ($As_2O_3$); the sample serves as a cathode, and the lead plate serves as an anode. A cathodic current density of 0.1 ampere per square centimeter (A/cm$^2$) is applied. The current is continuously applied during the test. Then the samples are subjected (loaded) to a stress at a given level for the tests, thereby making it possible to evaluate the hydrogen-brittleness-cracking resistance in terms of a period of time required until hydrogen-brittleness cracking takes place under different loads. The test method under cathode electrolysis is known to be extremely accelerated, as compared with other testing environments, such as a high-moisture atmosphere; and sea water.

Figure 4:
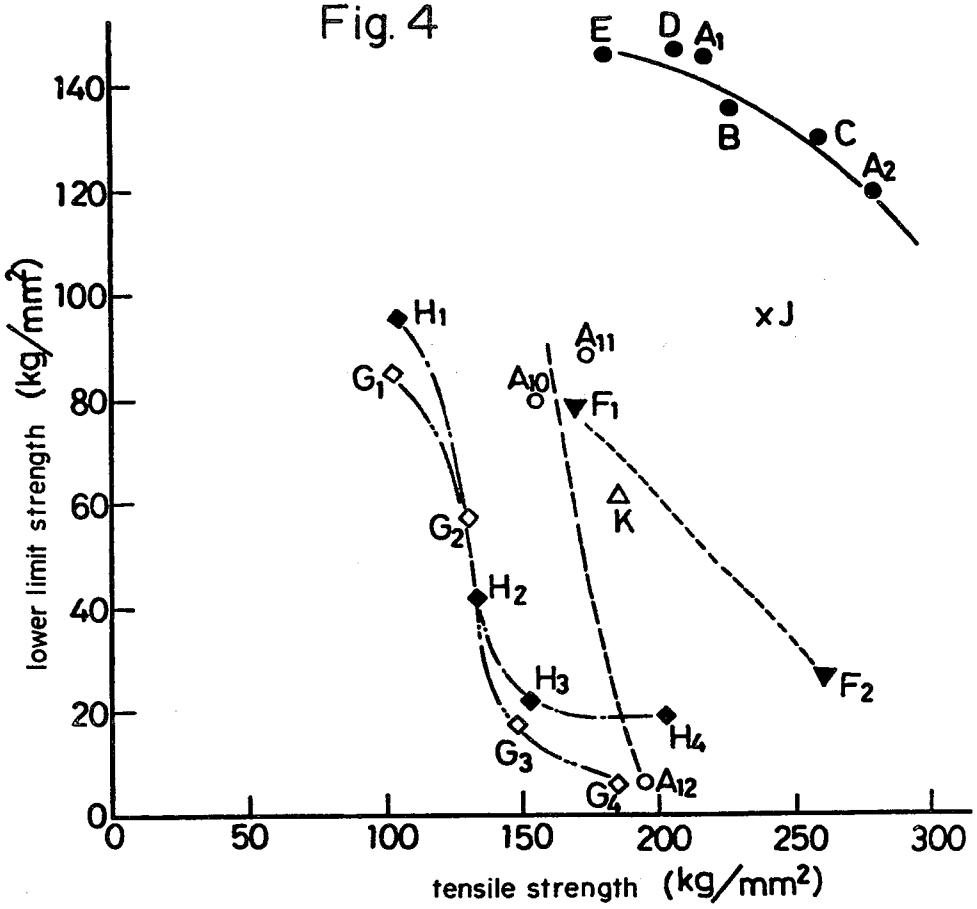
FIG. 4 is a graph representing the relationship between tensile strength and lower-limit strength to evaluate hydrogen-brittleness-cracking resistance of the steel samples prepared according to the present invention, plus steel samples used for comparison.

FIG. 4 illustrates test results which represent the relationship between tensile strength and lower-limit strength of each sample. The expression, "lower limit strength", as used herein, is defined as the strength of a sample which withstands a load for 10 hours under a cathode electrolysis condition in view of the relation between the aforenoted load or stress level and during the time required until the breaking of a sample.

The symbols A1, A2, B, C, D, E represent the results of steel samples obtained according to the process of the invention. The test conditions for A1 to E are hereinafter provided. Meanwhile, the numerical values appearing first (in parentheses) refer to tensile strength in kilograms per square millimeter (kg/mm$^2$), and the values appearing second (also in parentheses) refer to lower-limit stresses in kg/mm$^2$.

A1 (213, 146): The steel sample A is heated to 1180° C. quenched in warm water (maintained at a temperature of 50° C.) to provide a uniform austenite structure, and then forged or worked in one direction by means of rotary swages at the noted quenching temperature (50° C.), with a reduction in area of 89 percent and an amount of martensite of 50 percent by volume. Then, the sample A is tempered at 450° C.

A2 (280, 119): Forging results in a reduction in area of 95 percent; the resulting amount of martensite is 78 percent by volume. The remainder of the procedure is the same as that for A1.

B (225, 135): The steel sample B (after heating) is quenched in water maintained at 20° C. Reduction in area is 92 percent; the resulting amount of martensite is 70 percent by volume. The remainder of the procedure is the same as that for A1.

C (260, 130): The steel sample C after heating is quenched in ice water; reduction in area is 95 percent; the resulting amount of martensite is 80 percent by volume. The remainder of the procedure is the same as that for A1.

D (206, 146): The steel sample D (after heating) is quenched in oil maintained at 200° C.; reduction area is 65 percent; the resulting amount of martensite is 55 percent by volume. The remainder of the procedure is the same as that for A1.

E (180, 145): The steel sample E (after heating) is quenched in oil maintained at 240° C.; reduction in area is 64 percent; the resulting amount of martensite is 50 percent by volume. The remainder of the procedure is the same as that for A1.

As can be seen from FIG. 4, the lower-limit strength of steel samples prepared according to the process of the invention appears in the neighborhood of a line connecting A1 and A2. Thus, even when the tensile strength is increased, the lower-limit strength is not markedly lowered, thereby ensuring excellent hydrogen-brittleness-cracking resistance. FIG. 4 further illustrates the preparation of steel having a lower-limit strength of at least 100 (preferably at least 110) kg/mm$^2$ and a tensile strength of at least 150 kg/mm$^2$. These concurrent properties provide unusual products.

Figure 2:
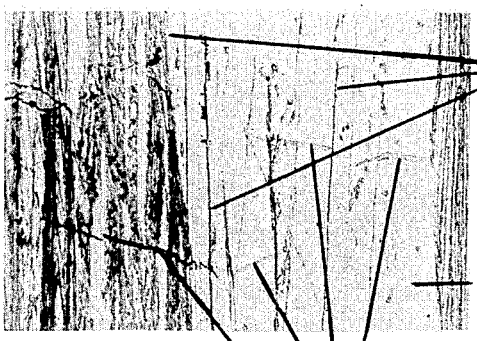
FIG. 2 is a photomicrograph illustrative of the cracking appearing in the structure of steel, coupled with a detailed structure thereof provided according to the process of the invention.

FIG. 2 is a photomicrograph showing the cracking in a structure of sample A1. A load applied parallel to the direction of lamellars develops cracking mostly in martensite and in a direction at a right angle to the direction of the lamellars. FIG. 2 shows that cracking discontinues in an austenite layer and that stress-induced martensite (caused by cracking) is present in the austenite layer in the direction of the extension of cracking. Meanwhile, the strength of steel of a composition according to the present invention is increased only by being tempered. Stress-induced martensite itself, as produced, thus remains in a tough state. Accordingly, even when stress-induced martensite is produced (due to cracking) in an austenite layer in the direction of the extension of cracking, the cracking can no longer be developed to a further extent because of the toughness of this stress-induced martensite.

The superb characteristic of high-hydrogen-brittleness-cracking resistance of the steel according to the present invention is clearly proved by comparison with hereinafter-described competitive prior art samples.

FIG. 4 reflects test results for competitive samples, as shown at $G_1$ to $G_4$, $H_1$ to $H_4$, $A_{10}$ to $A_{12}$, $F_1$ to $F_2$, J and K, wherein:

$G_1$ to $G_4$: JIS SCM3 (AISI 4135, the composition thereof being from 0.3 to 0.38 weight percent of C; from 0.15 to 0.35 weight percent of Si; from 0.60 to 0.85 weight percent of Mn; less than 0.030 weight percent of P; less than 0.030 weight percent of S; from 0.90 to 1.20 weight percent of Cr; from 0.15 to 0.30 weight percent of Mo; and the balance being substantially iron), which is used for high-strength bolts and nuts having high toughness, is hardened and tempered. Each sample is hardened by oil quench at 860° C. for 30 minutes. The tempering temperature and time required for the tempering of each sample are as follows: $G_1$: 625° C., 1 hr.; $G_2$: 490° C., 1 hr.; $G_3$: 410° C., 1 hr.; $G_4$: 200° C., 3 hrs. A sharp decrease in lower-limit stress arises when heat treatment results in a tensile strength in excess of 100 kg/mm$^2$.

$H_1$ to $H_4$: JIS SNCM8 (AISI 4340, the composition thereof being from 0.36 to 0.43 1 weight percent of C; from 0.15 to 0.35 weight percent of Si; from 0.60 to 0.90 weight percent of Mn; less than 0.030 weight percent of P; less than 0.030 weight percent of S; from 1.60 to 2.00 weight percent of Ni; from 0.60 to 1.00 weight percent of Cr; from 0.15 to 0.30 weight percent of Mo; and the balance being substantially iron, similar to SCM3 in characteristics) is hardened and tempered. Each sample is hardened by oil quench at 85° C. for 30 minutes. The tempering temperature and time required for the tempering of each sample are as follows: $H_1$: 650° C., 1 hr.; $H_2$: 520° C., 1 hr.; $H_3$: 420° C., 1 hr.; $H_4$: 200° C., 3 hrs. A change in lower-limit stress (strength) is similar to that for SCM3.

$A_{10}$ to $A_{12}$: The steel sample A of a composition given in the Table is sequentially subjected to a solution heat treatment at 1180° C., to a sub-zero treatment in liquified nitrogen, and tempering at a temperature in the range of from 500° to 650° C., thereby providing the steel with a tensile strength in a range of from 155 to 194 kg/mm$^2$. When the tensile strength exceeds 170 kg/mm$^2$, the lower-limit stress exhibits a sharp decrease. The presented data establish that the subject process imparts excellent and significantly-improved hydrogen brittleness-cracking resistance to steel to which it is applied.

J: A steel of a composition of Fe, C (0.3 weight percent), Si (2 weight percent), Mn (2 weight percent), Ni (8 weight percent), Cr (9 weight percent) and Mo (4 weight percent) is worked at a temperature immediately above the temperature Ms (to produce lamellar martensite extending in one direction) and then tempered. The martensite produced in this steel is brittle, so that the martensite in austenite, which has been produced due to cracking in worked martensite, is brittle, so that cracking develops along the martensite, thus hardly improving the hydrogen-birttleness-cracking resistance.

F1 to F2: The steel sample F (shown in the previously-presented Table) is quenched in ice water from a temperature of 1180° C., and then, immediately thereafter, quenched in (dry ice)/(ethyl alcohol), followed by forging by means of rotary swages at the quenched temperature, so as to produce lammellar martensite extending in one direction in an austenite matrix, followed by tempering at a temperature of 450° C.

F1: the amount of martensite is 20 percent by volume; reduction in area is 64 percent.

F2: the amount of martensite is 90 percent by volume; reduction in area is 95 percent. Tensile strengths obtained for $F_1$ and $F_2$ were 171 and 262 kg/mm$^2$, respectively, while the lower-limit strengths (used to evaluate hydrogen-brittleness-cracking resistance) were 77 and 29 kg/mm$^2$, respectively, providing no marked improvement in hydrogen-brittleness-cracking resistance. This is because of the high titanium content.

The test results confirm the relationship of titanium, aluminum and beryllium in steel according to the present invention, wherein their respective amounts should be such that $Ti \leqq \frac{1}{2}(Al+Be)$, and the total amount of these three elements should range from 1.5 to 6.0 atomic percent, based on the entire amount of steel as being 100 atomic percent. These limitations ensure the best and most consistent hydrogen-brittleness-cracking resistance.

K: The commercially available 17-7PH steel (Fe, 17.26 weight percent of Cr, 7.07 weight percent of Ni, 1.10 weight percent of Al) is sequentially subjected to solution heat treatment at 1050° C., quenching in water, forging by rotary swages to a reduction in area of 51 percent [providing lamellar martensite (65 percent by volume) extending in one direction in an austenite matrix], and then tempering at 480° C. The tensile strength of thus-treated steel is 186 kg/mm$^2$, while its lower-limit strength is at a value of 65 kg/mm$^2$.

As is apparent from the foregoing, the process according to the present invention comprises the steps of: working (in one direction) steel of a composition such that (a) martensite produced by the working is tough and (b) the tensile strength of the steel is increased by tempering, thereby providing a uni-directional lamellar martensite structure in an austenite matrix; and then tempering thus-prepared martensite to produce steel having high tensile strength and excellent hydrogen-brittleness-cracking resistance.

Prior art steel generally tends to exhibit an increasingly marked hydrogen-brittleness-cracking property as the tensile strength is increased. In contrast thereto, steel according to the present invention retains excellent hydrogen-brittleness-cracking resistance even when the tensile strength is significantly increased. In addition, steel alloys prepared according to the present invention are amenable to the application of cold working and cutting; various kinds of products thereof, formed into desired shapes, are subject to tempering to increase their tensile strength, thus finding a wide range of application.

From the foregoing description the artisan will appreciate that numerous variations can be effected without departing from the spirit or scope of the invention. The preceding text provides specific exemplification illustrative of the invention and of particular limitations thereof. It is readily apparent that the invention is not limited to the herein-provided specific exemplification.

What is claimed is:

1. Steel having excellent resistance to hydrogen-brittleness cracking, having a tensile strength of at least 150 $kg/mm^2$ and a lower-limit strength of at least 100 $kg/mm^2$.

2. Tempered steel according to claim 1.

3. Steel according to claim 2 comprising from 15 to 27 percent by weight of nickel, from 5 to 10 percent by weight of cobalt and from 1 to 7 percent by weight of molybdenum.

4. Steel according to claim 2 comprising from 0.2 to 2.0 percent by weight of titanium, from 0.2 to 2.5 percent by weight of aluminum and from 0.05 to 0.80 percent by weight of beryllium.

5. Steel according to claim 4 wherein the total amount of titanium (Ti), aluminum (Al) and beryllium (Be) in said steel is within a range of from 1.5 to 6.0 atomic percent, based on the entire amount of said steel being 100 atomic percent, and the relation of the amounts of these three elements in their amounts by atomic percent are such that $Ti \leqq \frac{1}{2}(Al+Be)$.

6. Steel according to claim 5 comprising from 15 to 27 weight percent of nickel, from 5 to 10 weight percent of cobalt and from 1 to 7 weight percent of molybdenum.

7. Steel according to claim 1 having at least 10 percent by volume of a uni-directional lamellar martensite structure in an austenite matrix.

8. Steel capable of being hardened by tempering and having a tough uni-directional lamellar martensite structure in an austenite matrix.

9. Steel according to claim 8 comprising from 15 to 27 weight percent of nickel, from 5 to 10 weight percent of cobalt and from 1 to 7 weight percent of molybdenum.

10. Steel according to claim 9 comprising from 0.2 to 2.0 percent by weight of titanium, from 0.2 to 2.5 weight percent of aluminum and from 0.05 to 0.80 weight percent of beryllium.

11. Steel according to claim 10 wherein the weight percent of titanium is equal to or less than half the sum of that of aluminum and that of beryllium.

12. Steel having high tensile strength and excellent hydrogen-brittleness-cracking resistance, such steel consisting essentially of from 15 to 27 weight percent of nickel, from 5 to 10 weight percent of cobalt, from 1 to 7 weight percent of molybdenum, from 0.2 to 2.0 weight percent of titanium, from 0.2 to 2.5 weight percent of aluminum, from 0.05 to 0.80 weight percent of beryllium and the balance being substantially iron, and having a structure composed of tempered martensite, having a uni-directional lamellar structure, in an austenite matrix.

13. Steel according to claim 12 wherein the tensile strength and the lower-limit strength, for evaluating hydrogen-brittleness-cracking resistance of the steel, are more than 150 $kg/mm^2$ and more than 110 $kg/mm^2$, respectively.

14. Steel according to claim 13 wherein the total amount of titanium (Ti), aluminum (Al) and beryllium (Be) therein is within the range of from 1.5 to 6.0 atomic percent, based on the entire amount of the steel as 100 atomic percent, and the relation between the amounts in atomic percent of these three elements is such that $Ti \leqq \frac{1}{2}(Al+Be)$.

15. Steel according to claim 13 wherein the amount of tempered martensite in the austenite matrix is within the range of from 10 to 95 percent by volume.

16. Steel according to claim 12 wherein the tensile strength is within the range of from 150 to 220 $kg/mm^2$ and the lower-limit strength is more than 140 $kg/mm^2$.

17. Steel according to claim 12 wherein the tensile strength is within the range of from 220 to 260 $kg/mm^2$ and the lower-limit strength is more than 130 $kg/mm^2$.

18. Steel according to claim 12 wherein the tensile strength is more than 260 $kg/mm^2$ and the lower-limit strength for evaluating hydrogen-brittleness-cracking resistance is more than 100 $kg/mm^2$.

19. Steel according to claim 12 which consists essentially of 25 weight percent of nickel, 9 weight percent of cobalt, 5 weight percent of molybdenum, 0.4 weight percent of titanium, 0.3 weight percent of aluminum, 0.60 weight percent of beryllium and the balance substantially iron.

20. Steel according to claim 12 which consists essentially of 25 weight percent of nickel, 9 weight percent of cobalt, 5 weight percent of molybdenum, 0.4 weight percent of titanium, 2.0 weight percent of aluminum, 0.08 weight percent of beryllium and the balance substantially iron.

21. Steel according to claim 12 which consists essentially of 25 weight percent of nickel, 9 weight percent of cobalt, 5 weight percent of molybdenum, 1.4 weight percent of titanium, 0.8 weight percent of aluminum, 0.26 weight percent of beryllium and the balance substantially iron.

22. Steel according to claim 12 which consists essentially of 20 weight percent of nickel, 9 weight percent of cobalt, 5 weight percent of molybdenum, 0.4 weight percent of titanium, 0.3 weight percent of aluminum, 0.60 weight percent of beryllium and the balance substantially iron.

23. A steel according to claim 12 which consists essentially of 18 weight percent of nickel, 9 weight percent of cobalt, 5 weight percent of molybdenum, 0.4 weight percent of titanium, 0.3 weight percent of aluminum, 0.60 weight percent of beryllium and the balance substantially iron.

24. A process which comprises uni-directionally working steel having a uniform austenite structure to form therein a tough uni-directional lamellar martensite structure in an austenite matrix, the martensite structure being capable of strengthening by tempering.

25. A process for producing steel having high tensile strength and excellent resistance to hydrogen-brittleness cracking which comprises a process according to claim 24 followed by tempering.

26. A process according to claim 25 wherein the working is sufficient to produce at least 10 percent by volume of the tough uni-directional lamellar martensite structure in the steel.

27. A process which comprises heating steel to a temperature within the range of from 850° C. to the melting point thereof to impart therein a uniform austenite structure and subsequently quenching the steel prior to proceeding according to claim 26.

28. A process according to claim 27 for producing steel having high tensile strength and excellent hydrogen-brittleness-cracking resistance, comprising the steps of: heating, to a temperature within the range of from 850° C. to a melting point, initial or starting steel containing, by weight, from 15 to 27 percent of nickel, from 5 to 10 percent of cobalt, from 1 to 7 percent of molybdenum, from 0.2 to 2.0 percent of titanium, from 0.2 to 2.5 percent of aluminum, from 0.05 to 0.80 percent of beryllium, and the balance consisting essentially of iron;

quenching the thus-heated steel to a temperature within the range from an Ms temperature of the steel to a temperature which is 150° C. higher than the Ms temperature to provide said steel with a uniform austenite matrix;

working the thus quenched steel in one direction within the quenching temperature range to form a uni-directional lamellar structure of martensite in the austenite matrix; and tempering the thus-worked steel to increase the strength thereof.

29. A process according to claim 28 wherein the total of titanium (Ti), aluminum (Al) and beryllium (Be) in said steel is within a range of from 1.5 to 6.0 atomic percent, based on the entire amount of said steel being 100 atomic percent, and the relation of the amounts of these three elements in their amounts by atomic percent are such that $Ti \leqq \frac{1}{2}(Al+Be)$.

30. A process according to claim 28 wherein said uni-directional working is applied to said steel with a reduction in area in a range of from 45 to 99 percent to form a uni-directional lamellar structure of martensite of from 10 to 95 percent by volume in said austenite matrix.

31. A process according to claim 28 wherein steel, containing 25 weight percent of nickel, 9 weight percent of cobalt, 5 weight percent of molybdenum, 0.4 weight percent of titanium, 0.3 weight percent of aluminum, 0.60 weight percent of beryllium and the balance consisting essentially of iron, is heated to a temperature of 1180° C., is quenched in warm water maintained at a temperature of 50° C. to provide a uniform austenite matrix, is forged by means of a rotary swage at the quenching temperature of 50° C. with a reduction in area of 89 percent to form a uni-directional lamellar structure of martensite of 50 percent by volume, and is tempered at a temperature of 450° C.

32. A process according to claim 28 wherein steel, containing 25 weight percent of nickel, 9 weight percent of cobalt, 5 weight percent of molybdenum, 0.4 weight percent of titanium, 0.3 weight percent of aluminum, 0.60 weight percent of beryllium, and the balance consisting essentially of iron, is heated to a temperature of 1180° C., is quenched in warm water maintained at a temperature of 50° C. to provide a uniform austenite matrix, is forged by means of a rotary swage at the quenching temperature of 50° C. with a reduction in area of 95 percent to form a uni-directional lamellar structure of martensite of 75 percent by volume, and is tempered at a temperature of 450° C.

33. A process according to claim 28 wherein steel, containing 25 weight percent of nickel, 9 weight percent of cobalt, 5 weight percent of molybdenum, 0.4 weight percent of titanium, 2.0 weight percent of aluminum, 0.08 weight percent of beryllium and the balance consisting essentially of iron, is heated to a temperature of 1180° C., is quenched in water maintained at a temperature of 20° C. to provide a uniform austenite matrix, is forged by means of a rotary swage at the quenching temperature of 20° C. with a reduction in area of 92 percent to form a uni-directional lamellar structure of martensite of 70 percent by volume, and is tempered at a temperature of 450° C.

34. A process according to claim 28 wherein steel, containing 25 weight percent of nickel, 9 weight percent of cobalt, 5 weight percent of molybdenum, 1.4 weight percent of titanium, 0.8 weight percent of aluminum, 0.26 weight percent of beryllium and the balance consisting essentially of iron, is heated to a temperature of 1180° C., is quenched in ice water of 0° C. to provide a uniform austenite matrix, is forged by means of a rotary swage at said quenching temperature of 0° C. with a reduction in area of 95 percent to form a uni-directional lamellar structure of martensite of 80 percent by volume and is tempered at a temperature of 450° C.

35. A process according to claim 28 wherein steel, containing 20 weight percent of nickel, 9 weight percent of cobalt, 5 weight percent of molybdenum, 0.4 weight percent of titanium, 0.3 weight percent of aluminum, 0.60 weight percent of beryllium and the balance consisting essentially of iron, is heated to a temperature of 1180° C., is quenched in oil maintained at a temperature of 200° C. to provide a uniform austenite matrix, is forged by means of a rotary swage at said quenching temperature of 200° C. with a reduction in area of 65 percent to form a uni-directional lamellar martensite structure of 55 percent by volume, and is tempered at a temperature of 450° C.

36. A process according to claim 28 wherein steel, containing 18 weight percent of nickel, 9 weight percent of cobalt, 5 weight percent of molybdenum, 0.4 weight percent of titanium, 0.3 weight percent of aluminum, 0.60 weight percent of beryllium and the balance consisting essentially of iron, is heated to a temperature of 1180° C., is quenched in oil maintained at a temperature of 240° C. to provide a uniform austenite matrix, is forged by means of a rotary swage at the quenching temperature of 240° C. with a reduction of area of 64 percent to form a uni-directional lamellar martensite structure of 50 percent by volume, and is tempered at a temperature of 450° C.

37. A process according to claim 28 wherein said tempering is carried out within a temperature range of from 300° to 600° C.

* * * * *